US005341711A

United States Patent [19]

Stay, Jr. et al.

[11] Patent Number: 5,341,711

[45] Date of Patent: Aug. 30, 1994

[54] FINGERSAVER

[76] Inventors: Francis E. Stay, Jr., 1725 Pathfinder Dr., Virginia Beach, Va. 23454; Robert A. Hoyt, R.D. 1, Box 116, Centerline Rd., Galway, N.Y. 12074

[21] Appl. No.: 21,568

[22] Filed: Feb. 24, 1993

[51] Int. Cl.[5] ..... B27B 25/10

[52] U.S. Cl. ..... 83/425; 83/437; 83/438; 83/477.2

[58] Field of Search ..... 83/421, 425, 435.1, 83/437, 438, 477.2

[56] References Cited

U.S. PATENT DOCUMENTS

| | | | |
|---|---|---|---|
| 2,410,467 | 11/1946 | Valentine | 83/437 |
| 4,026,173 | 5/1977 | Livick | 83/421 |
| 4,348,925 | 9/1982 | Manweiler | 83/435.1 |
| 4,370,909 | 2/1983 | Jennings | 83/437 |
| 4,485,711 | 12/1984 | Schnell | 83/425 |
| 4,603,612 | 8/1986 | Atkins | 83/425 |

*Primary Examiner*—Eugenia Jones

[57] ABSTRACT

A transparent safety device and pushing tool with an adjustable and reversible shoe member for depth and angle used to push, hold down, and guide work pieces through or over cutting devices. The adjustable and reversible shoe member can be removed and reassembled for use by either a right or left handed user, while keeping the user's hands, extremities, and clothing up and away in a much safer position with respect to the cutting device. The safety device and pushing tool has an elongated slot in the main member's lower front section that allows the main member to be rotated to the rear while still allowing the shoe member to remain flat on the rip fence, straight edge or guide bar at all times while being used. Also, should the tool receive minimal damage, it could be repaired by the user, eliminating constant replacement costs.

1 Claim, 2 Drawing Sheets

FINGERSAVER

FIELD OF THE INVENTION

The invention described herein is used in the field of woodworking and cutting applications.

BACKGROUND OF THE INVENTION

The invention herein relates to a transparent and adjustable safety device and pushing tool, with a shoe member and a heel piece, made of a sturdy material such as "plexiglas", lexan, etc. for the protection of the user's hands, fingers, and extremities, as well as allowing the user to clearly see through, around, and under said device, while holding down, guiding, and pushing a work piece through or over cutting devices such as tablesaws, circular saws mounted to tables, routers, etc. Because of the minimal size of said safety device and pushing tool, it would allow for finer cuts to be made while at the same time putting the user's hands, fingers, and upper extremities in a much safer position, up and away from the cutting device as opposed to how previous or similar devices place the user's hands directly in front of or over the cutting device. The safety device and pushing tool is designed with a shoe member in such a way that it rides on top of the rip fence, or other straight edge used to guide the work piece in a straight forward line through or over the cutting device while still maintaining contact with the work piece until it clears the cutting device. By using the two vertical slots in the main member said safety device and pushing tool is also adjustable for various thicknesses of the work piece, and is also reversible for either a right hand or left handed user. The safety device and pushing tool also has an angled slot at the bottom of the front vertical slot of the main member for an adjustment that allows the user to be able to rotate the main member back and still place the shoe member flat on the rip fence, guide bar or other straight edge and be able to stand back and straight up more so and not to have to lean as far over the cutting device while extending his arm forward to push the work piece through the cutting device, thus reducing the potential for chips, saw dust, etc., or the work piece to kick back, hitting the user in the upper extremities.

Pusher device have been designed and developed commercially and privately where the user uses a wooden pusher or some other object to push a work piece by, through, or over a cutting device thus, trying to reduce the potential for injury. A problem with other pusher devices is that they are large, sometimes not of the proper material, or are designed to be used almost directly in front of, over, or in close proximity to the cutting device itself; thus, putting the user's hands and or other extremities at risk of injury should the pushing device or the work piece lurch forward or kick up away from the cutting device and the user be forced to or lose his balance and go forward, or should the user not realize or miscalculate the depth the cutter is going to make and have the cutter cut through the pushing device itself and come in contact with his extremities. Not only is there the potential for injury, but the costly replacement of the pushing tool.

SUMMARY OF INVENTION

We have devised a safety device and pushing tool as shown in the following description of the drawings that when being used, and due to its constructive dimensions as well as strength properties reduces the area the safety device and pushing tool needs to clear the cutting device itself and while still holding down, pushing, and or guiding a work piece through or over a cutting device places the user's hands, fingers, and upper extremities up and away from the cutting device itself, in such a way, thus eliminating the potential for injury considerably, and due to the material composition of said safety device and pushing tool, should the cutting device in some way come in contact with it, it can cut through it, allowing the user to still hold it and control it being as it is always supported by the top of the rip fence, straight edge or other guide and should minimal damage be caused to the heel area it could be repaired by the user and still maintain its safety features and usefulness. Accordingly, one object of the invention is to provide a combined safety device and pushing tool for the protection of the user's extremities as well as reduce replacement costs. Other objects of the invention will appear in the following descriptions.

DESCRIPTION OF THE PREFERRED EMBODIMENT

Figure 2:
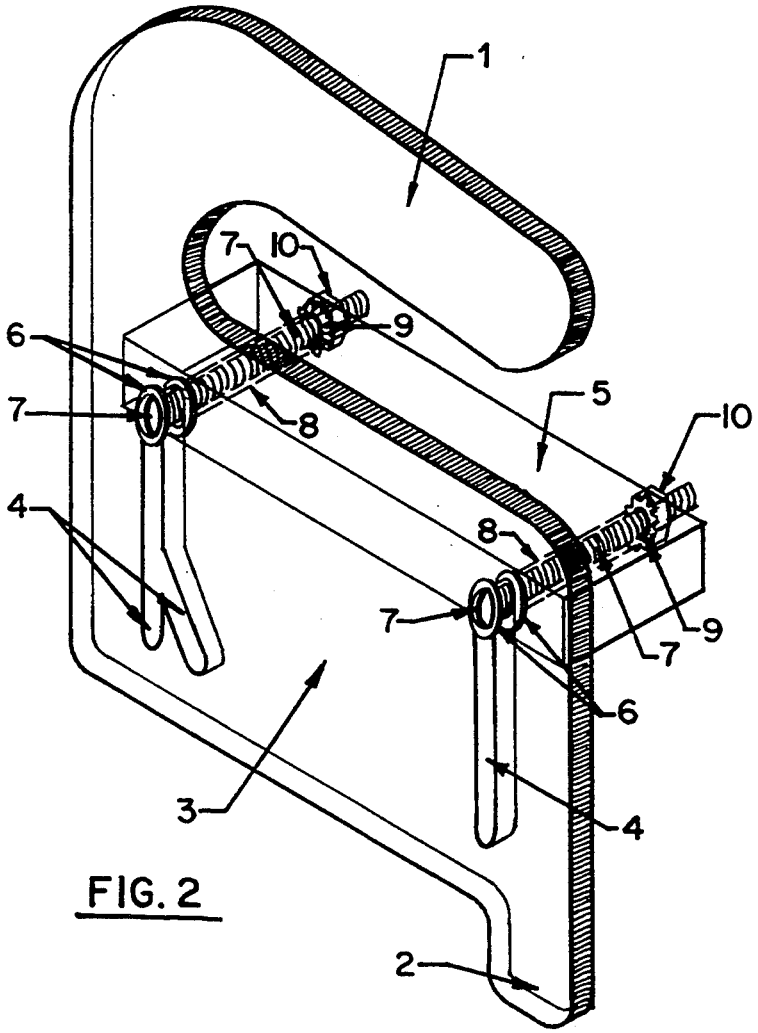
FIG. 2 is a perspective view of the preferred embodiment with the adjustable and reversible shoe member attached to the invention's main member.

As shown in FIG. 2, the preferred embodiment is made up of the main member 3, a handle piece 1, a heel piece 2, two vertical elongated slots 4, one angled slot 4, the adjustable and reversible shoe member 5 and two assembly and adjusting screws 7, four flat washers 6, two star washers 9 and two nuts 10.

As shown in FIGS. 4, 5, 6 and 7 the adjustable and reversible shoe member 5 has two predrilled holes 8 passing through it, through which the two assembly and adjusting screws 7 pass.

Figure 1:
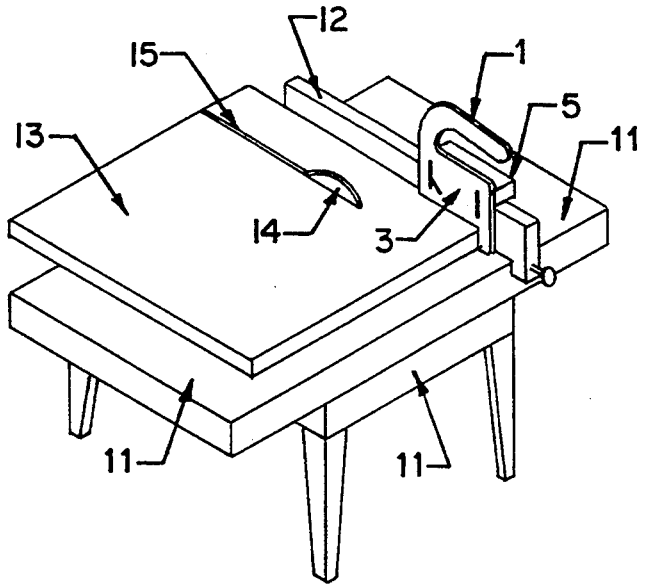
FIG. 1 is a perspective view of the preferred embodiment with the adjustable and reversible shoe member.

Referring to FIG. 1, the safety device and pushing tool 1,3,5 described herein is some what "C" shaped with a heel extension 2 on the lower rear portion of the main member 3, and as shown in FIG. 1 engages the work piece 13 or item to be pushed through the cutting device 14, and an adjustable and reversible shoe member 5 which is assembled to either side of the main member 3 for sliding along the top of the rip fence 12, straight edge or guide bar.

Referring to FIG. 1 and 2 the shoe member 5 is adjusted for a given depth by placing the work piece on the cutting device's table 11, and loosening the assembly and adjusting screws 5. The main member 3 is placed on the work piece 13 and against the guide 12. The shoe member 5 is slid down on top of the guide 12 and the heel piece 2 engages the work piece 13 from behind.

Figure 3:
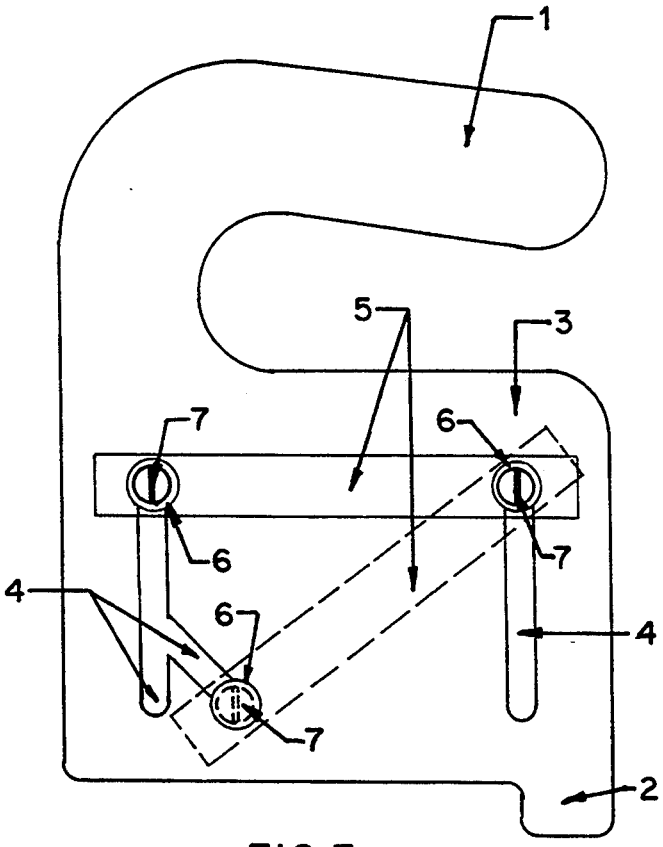
FIG. 3 shows a side view of the pushing device as would be seen by a right or left hand user and how the adjustable and reversible shoe member can be tilted or angled for shorter work pieces.
Figure 4:
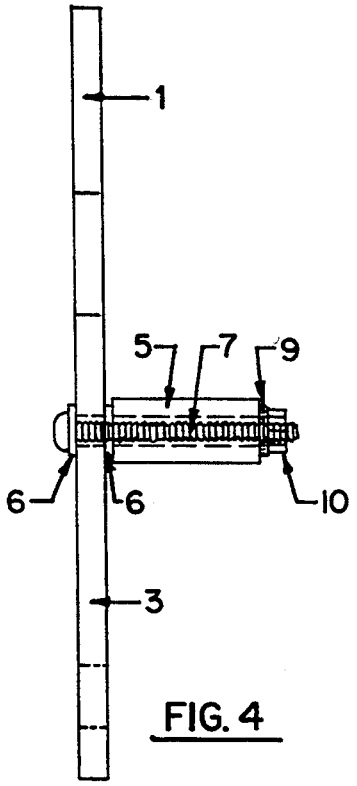
FIG. 4 shows a rear view of the invention as described herein, with the mounting and adjusting screws passing through the main member and the shoe member.
Figure 5:
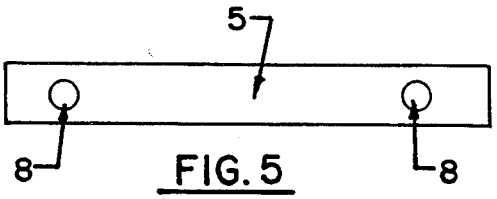
FIG. 5 shows a side view of the invention's shoe member with the mounting and adjusting screw holes passing through it.
Figure 6:
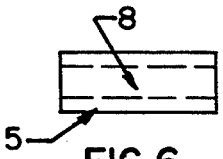
FIG. 6 shows an end view of the invention's shoe member.
Figure 7:
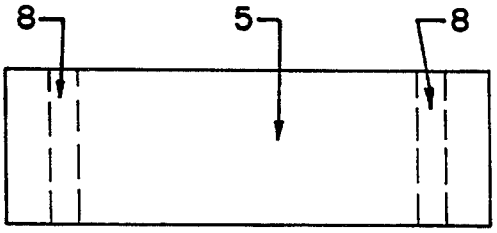
FIG. 7 shows a top view of the invention's shoe member.

Referring to FIG. 3 the angle is adjusted by loosening two assembly and adjusting screws which will allow the rear of the shoe member 5 to slide up in the rear vertical slot 4, while the front of the shoe member 5 slides down into the angled slot 4, while the main member 3 and the heel piece 2 are rotated backward 45 degrees. This angled position allows the user to stand up straighter and away from the cutting device 14.

I claim:

1. An adjustable and reversible safety tool and pushing device used to push, hold down, and guide work pieces through a cutting device comprising;

(a) a transparent main member including a handle, a heel piece, two vertically elongated slots and one angled slot extending through the main member, said angled slot connected to and extending at an acute angle with respect to one of said vertically elongated slots;

(b) a transparent shoe member including two mounting holes extending through said shoe member;

(c) means for attaching the shoe member to the main member, said attaching means extending through two of said slots in said main member and through said holes in said shoe member;

(d) said angled slot allowing the shoe member to be positioned at an acute angle with respect to a direction of longitudinal extension of the main member, wherein, even when the shoe member is attached to the main member through the angled slot, said shoe member lays flat on top of a rip fence mounted to a table and the main member contacts a work piece during use of the pushing device.

* * * * *